US009027280B2

(12) United States Patent
Huddleston

(10) Patent No.: US 9,027,280 B2
(45) Date of Patent: May 12, 2015

(54) STORM PANEL LOCKING DEVICE

(71) Applicant: Tammy Lee Huddleston, Vero Beach, FL (US)

(72) Inventor: Tammy Lee Huddleston, Vero Beach, FL (US)

( * ) Notice: Subject to any disclaimer, the term of this patent is extended or adjusted under 35 U.S.C. 154(b) by 152 days.

(21) Appl. No.: 13/898,344

(22) Filed: May 20, 2013

(65) Prior Publication Data

US 2014/0338263 A1 Nov. 20, 2014

(51) Int. Cl.
*E05C 21/00* (2006.01)
*E06B 9/02* (2006.01)
*E06B 9/00* (2006.01)

(52) U.S. Cl.
CPC . *E05C 21/00* (2013.01); *E06B 9/02* (2013.01); *E06B 2009/005* (2013.01)

(58) Field of Classification Search
USPC ..... 49/463, 50, 57, 61, 62; 52/202, 203; 292/259 R, 262, 263, 265, DIG. 60
IPC ..... E05C 21/00; E06B 9/02,2900/005
See application file for complete search history.

(56) References Cited

U.S. PATENT DOCUMENTS

| | | | | | |
|---|---|---|---|---|---|
| 1,707,694 | A * | 4/1929 | Torrence | 70/134 |
| 1,779,491 | A * | 10/1930 | Rau | 292/259 R |
| 4,082,332 | A * | 4/1978 | Palmer | 292/259 R |
| 4,349,223 | A * | 9/1982 | Spector | 292/259 R |
| 4,590,706 | A * | 5/1986 | Plowman | 49/57 |
| 4,613,175 | A | 9/1986 | Nelson | |
| 4,685,261 | A | 8/1987 | Seaquist | |
| 5,077,940 | A * | 1/1992 | LaRose, Jr. | 49/503 |
| 5,335,452 | A * | 8/1994 | Taylor | 49/463 |
| 5,383,315 | A * | 1/1995 | Birs | 52/202 |
| 5,605,364 | A * | 2/1997 | Shelledy | 292/259 R |
| 5,768,833 | A | 6/1998 | Golen | |
| 5,852,903 | A | 12/1998 | Astrizky | |
| 6,079,168 | A | 6/2000 | Shaver | |
| 6,205,713 | B1 | 3/2001 | Thompson et al. | |
| 6,532,702 | B1 | 3/2003 | Scribner | |
| 6,560,925 | B1 * | 5/2003 | Rice | 49/141 |
| 6,886,294 | B1 | 5/2005 | Carey | |
| 6,910,312 | B2 | 6/2005 | Whitworth | |
| 6,978,579 | B1 | 12/2005 | Trinca | |
| 7,044,512 | B1 * | 5/2006 | Moreno | 292/259 R |
| 7,069,700 | B2 | 7/2006 | Heissenberg | |
| 7,559,715 | B2 | 7/2009 | Germain et al. | |
| 7,634,878 | B1 | 12/2009 | Motosko | |
| 7,682,100 | B2 | 3/2010 | Duval | |
| 7,766,573 | B1 | 8/2010 | Wolf | |
| 8,091,285 | B1 | 1/2012 | Wolf et al. | |
| 8,245,457 | B2 | 8/2012 | Eickhof | |
| 2005/0039402 | A1 * | 2/2005 | Murphy et al. | 49/57 |
| 2005/0193651 | A1 | 9/2005 | Kirk | |
| 2005/0211396 | A1 | 9/2005 | Doiron et al. | |
| 2005/0284026 | A1 | 12/2005 | DuBose | |

* cited by examiner

*Primary Examiner* — Gregory Strimbu
(74) *Attorney, Agent, or Firm* — Bruce A. Lev

(57) ABSTRACT

A universal locking device for securing flat or corrugated hurricane storm panels in place to avoid unauthorized removal and entry into a building. The locking device includes a combination of brackets removably secured between the building and the storm panels, and an adjustable locking bar locking these elements securely together.

20 Claims, 7 Drawing Sheets

STORM PANEL LOCKING DEVICE

PRIORITY

This application claims priority to Provisional application No. 61/848,215, filed Dec. 27, 2012.

FIELD OF THE INVENTION

This invention relates generally to hurricane protective coverings commonly known as hurricane shutters and storm panels that are used in hurricane high wind conditions to protect windows and doors openings in houses and other structures from damage caused by flying debris, and more particularly to a universal locking device which secures such hurricane shutters and storm panels in place from unauthorized removal and entry into a building.

BACKGROUND OF THE INVENTION

This invention is directed to a universal locking device for flat or corrugated hurricane shutters or storm panels made of steel, aluminum, polycarbonate, plywood, plastics or composites installations, including a single storm panel or multiple storm panels that have an overlapping engagement at their adjoining edges to form a single panel in a vertical or horizontal configurations of various lengths or widths including types of mounting systems attached directly to a building securing the sides, top, or bottom of the hurricane shutter or storm panels. The universal locking device deploys in horizontal, vertical or diagonal positions across the outer portion of the hurricane shutters and storm panels with the direct mount systems including panel mount anchors or end brackets secured directly to a building wall securing the hurricane shutters and storm panels securely thereto.

Related prior art includes U.S. Patent Application US2005/0193651, which teaches a shutter assembly for storm and security protection, wherein one embodiment of the assembly consists of translucent panels enclosed within the upper and lower track of housing and comprisies a locking device.

U.S. Pat. No. 6,205713 to Thompson, et al. teaches hurricane protection for windows and doors comprising a shutter with hardware and a locking rod device with padlock.

U.S. Pat. No. 6,532,702 to Scribner teaches safeguarding a building from vandals or storms comprising panel members and spring loaded locking inserts.

Storm resistant fixed shutter assemblies are taught by Carey U.S. Pat. No. 6,886,294 and Whitworth, which disclose a storm brace assembly in U.S. Pat. No. 6,910,312.

U.S. Pat. No. 7,634,878 of Motosko teaches a shutter assembly for storm and security protection, two embodiments of the assembly consistis of a header upper track mount and a lower F-track mount and positional hasp and padlock.

SUMMARY OF THE INVENTION

This invention generally relates to a universal locking device for hurricane shutters or storm panels. Before, during and after a storm, many homes and buildings are left unoccupied by mandatory or voluntary evacuations, leaving buildings noticeably vulnerable to vandals and burglars, and by the simple removal of a conventional storm panels or plywood, easy access into the unoccupied building.

One embodiment of the universal locking device is for flat or corrugated hurricane shutters or storm panels made of steel, aluminum, polycarbonate, plywood, plastics or composite installations including a single storm panel sized to cover and protect windows and glass doors of a building, and multiple flat or corrugated panels made of any of the aforementioned materials that overlapping engagement at their adjoining edges to form a single panel in a vertical or horizontal configurations of unlimited lengths or widths including mounting systems attached directly to a building wall securing the sides, top, or bottom of the hurricane shutter or storm panels.

The universal locking device deploys in horizontal, vertical, or diagonal positions across the outer portion of the hurricane shutters and storm panels with mounting systems including panel mount anchors or end brackets secured directly into a building securing the shutters and storm panels with washer wing nuts or threaded anchors and sidewalk screws, or in combination with mounts with or without H and U standard header or build-out tracks securing the top, bottom, or sides of hurricane shutters or storm panels with unlimited lengths or widths.

Furthermore, the universal locking device deploys vertically or horizontally to secure the side or bottom of a studded angel track, reverse studded angel track, build-out angel track, F-track, reverse F-track, build-out F-track or in combination with direct mounts with or without H or U header tracks with unlimited lengths or widths mounted to a building.

The universal locking device locking bar includes a padlock having a hasp at one end, and drilled holes at a bar tong end allowing the locking device to be secured at one of two points or both, which prevents any substantial movement of the top, side, or bottom edge of the aforementioned mounting attachments and combinations of the hurricane shutter or storm panel members.

Furthermore the locking bar tong end has a coupling adapted to extend to unlimited lengths or widths.

It is therefore an object of this invention to provide a universal locking device that is easy to use for multiple types of hurricane shutters and storm panels and multiple mounting systems which renders them non-removable when locked with a padlock.

Another object of this invention is to provide hurricane shutters and storm panels a universal locking device that is easily and quickly removed by unlocking of the padlock.

And another object of this invention is that the universal locking device deploys without any modifications to the hurricane shutters, or storm panels, or attachment mounts, or tracks mounts, or the building structure, or windows, or door frames.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
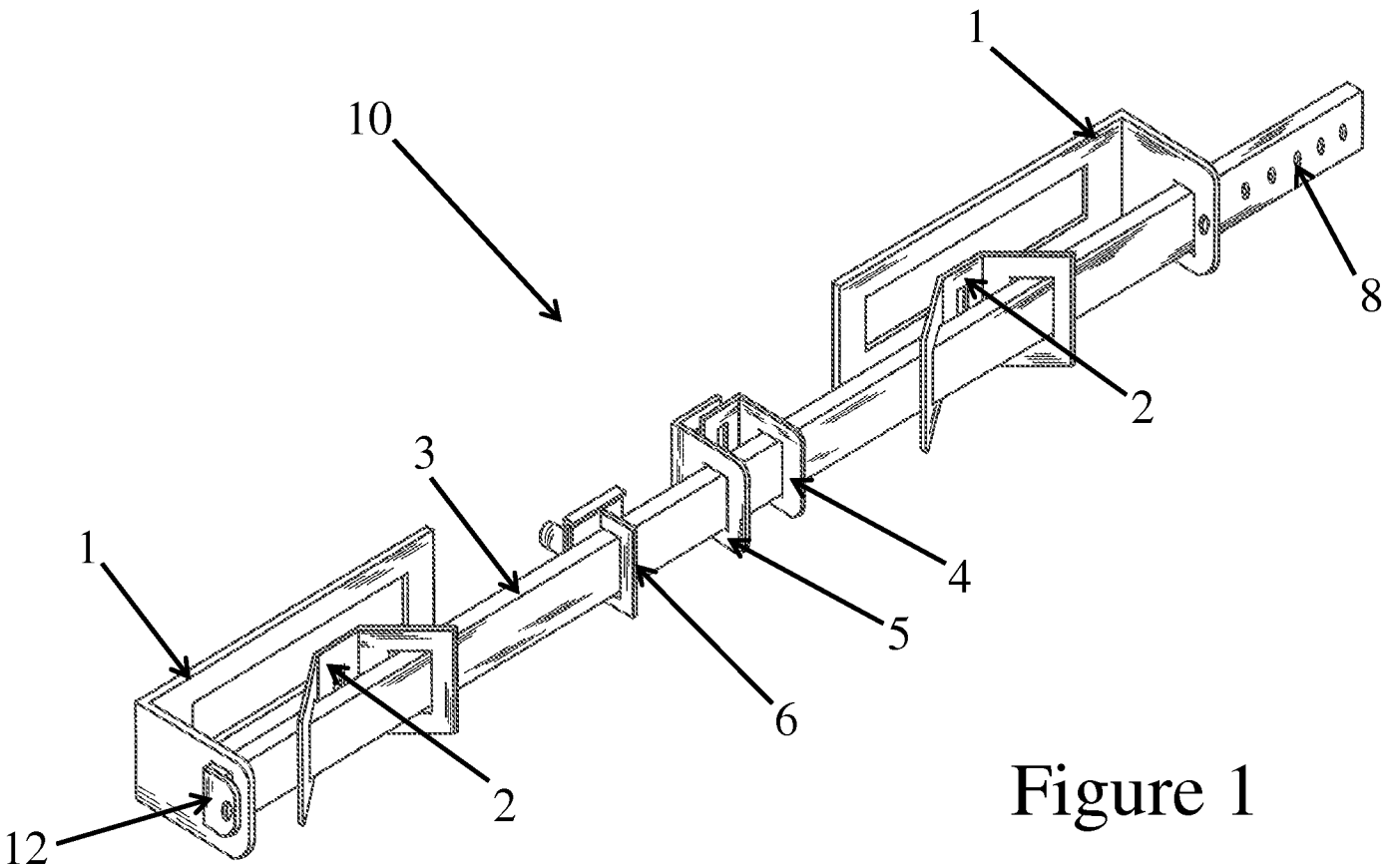
FIG. 1 is a perspective view of the universal locking device with the locking bar inserted through each component and incorporating a padlock on the tong end.
Figure 2:
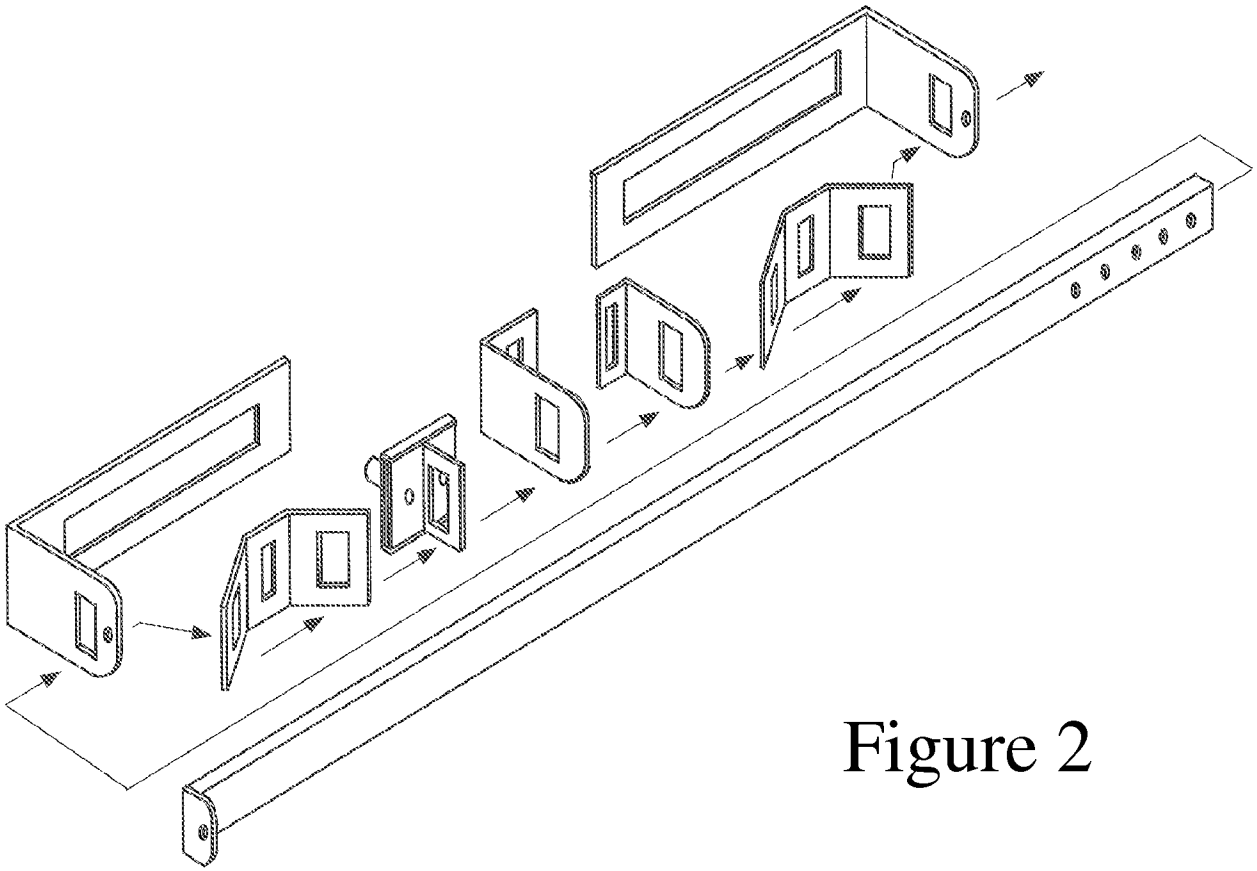
FIG. 2 is an exploded view of universal locking device components and showing the direction as to which the locking bar is inserted therethrough.
Figure 3:
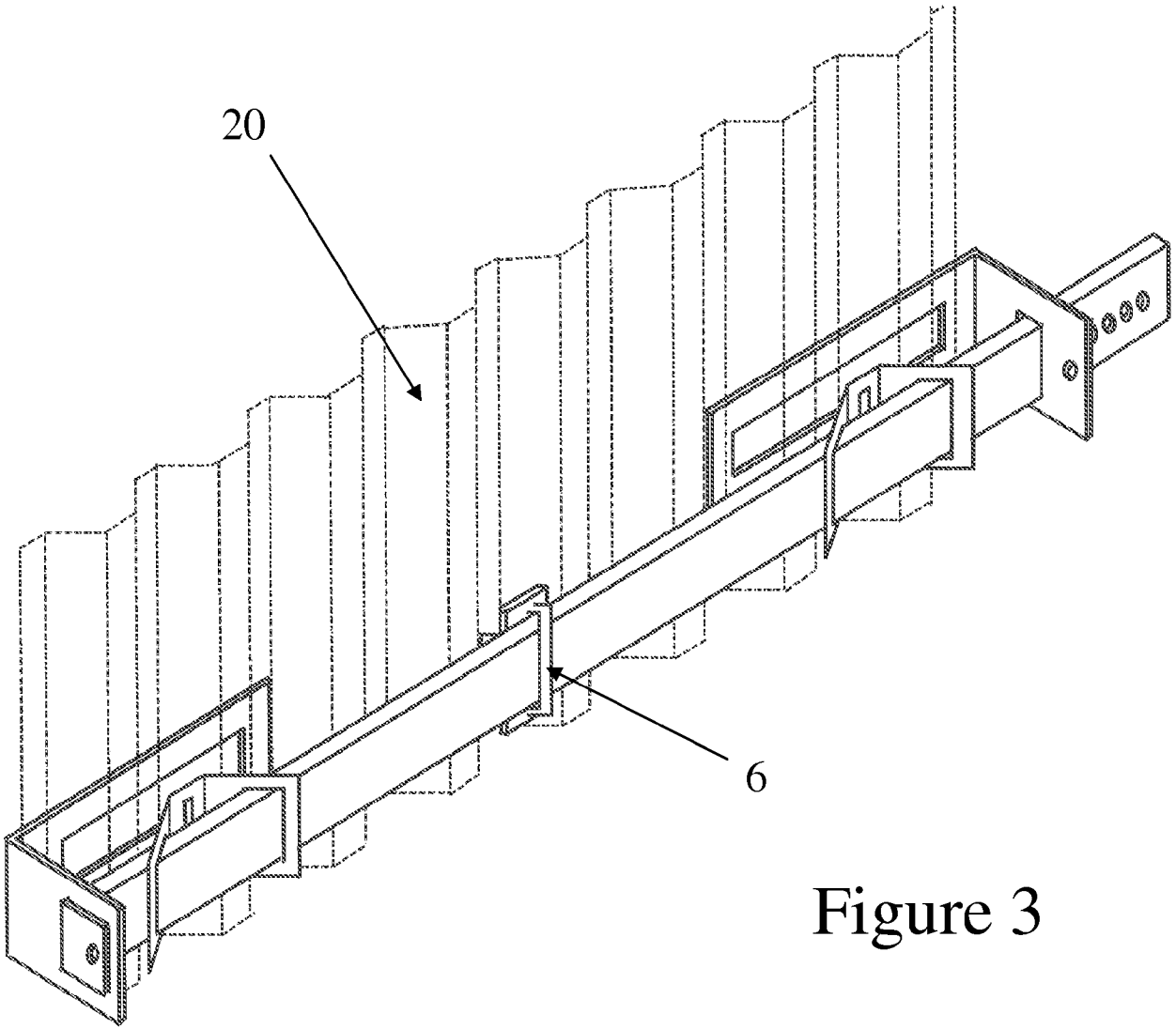
FIG. 3 is a perspective view of one embodiment of the universal locking device deployed upon a corrugated hurricane shutter panel, and incorporating the central panel locking brace.
Figure 4:
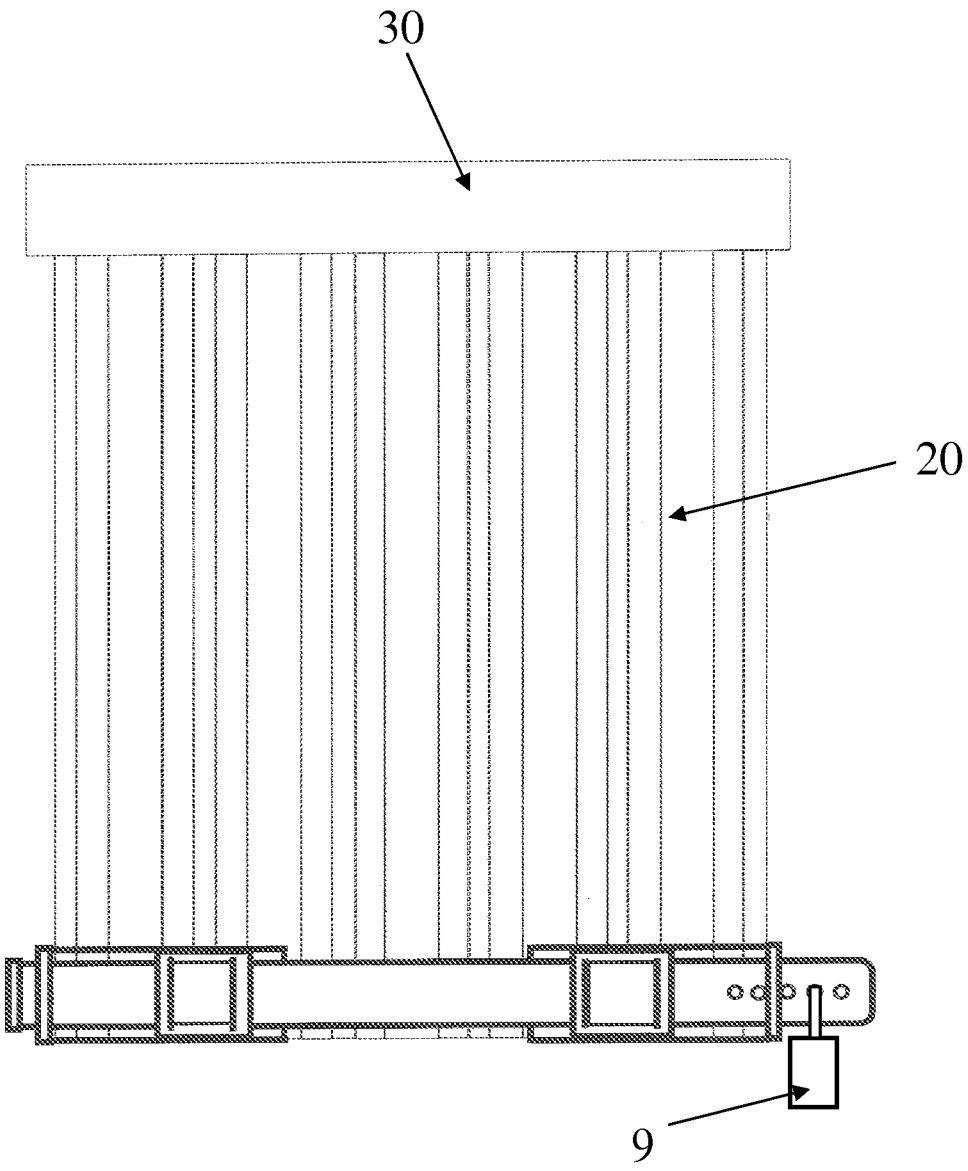
FIG. 4 is a perspective view of the universal locking device deployed upon a corrugated hurricane shutter panel including an upper track member(30).
Figure 5:
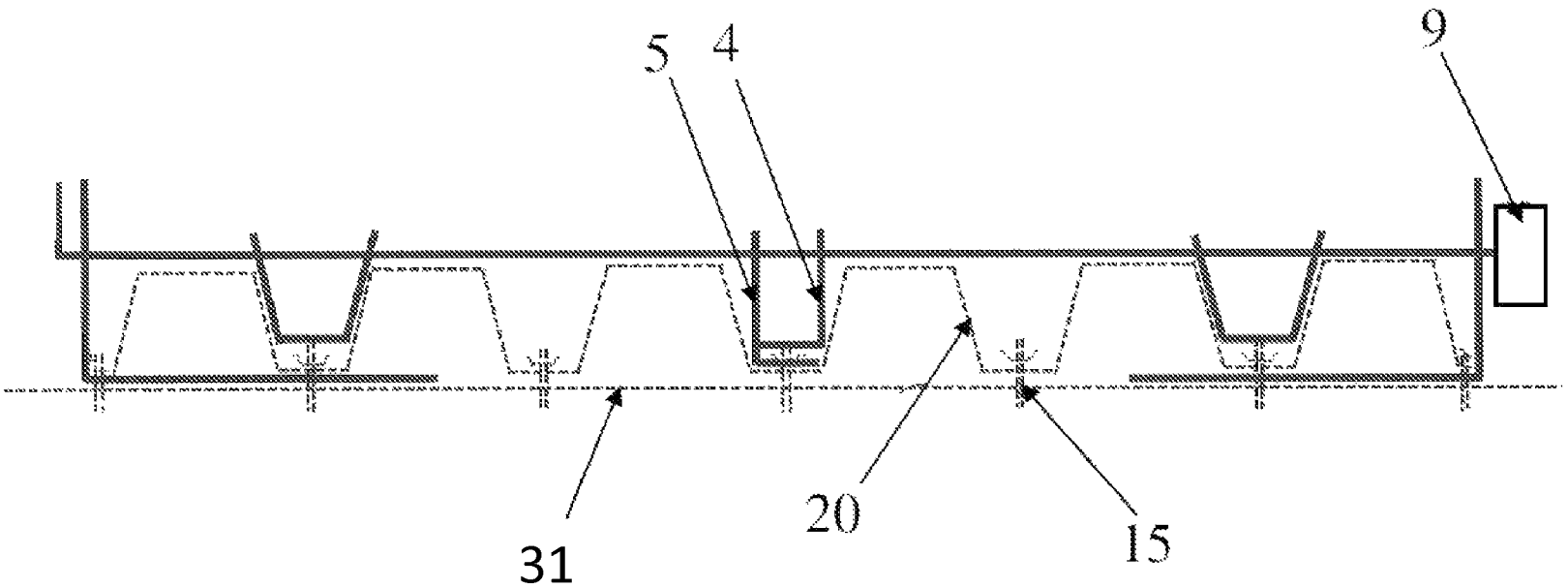
FIG. 5 is a cross-sectional view of a second embodiment of the universal locking device deployed upon a corrugated hurricane shutter panel, and incorporating the central brace and center panel lock.
Figure 6:
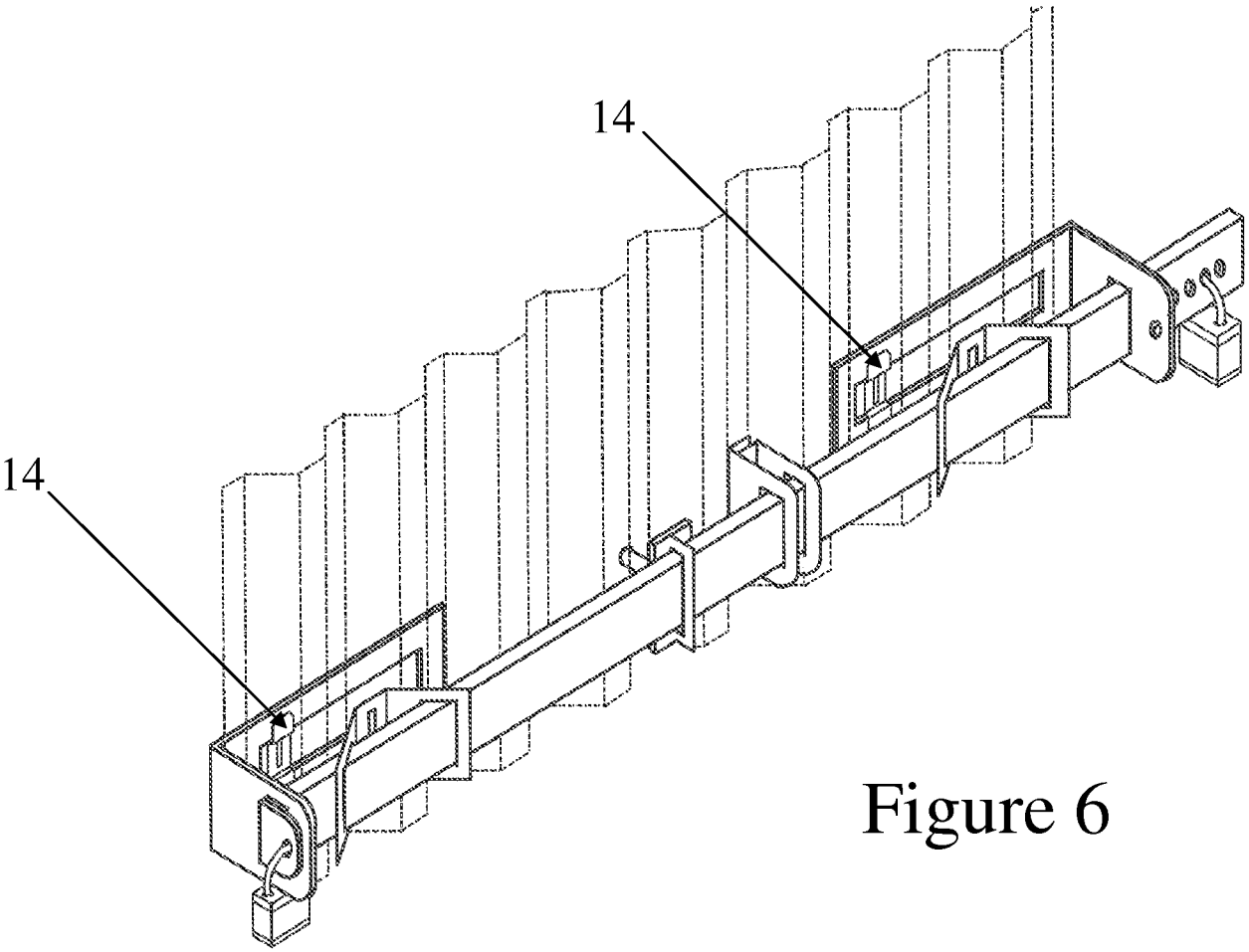
FIG. 6 is a perspective view of an alternate embodiment of the universal locking device deployed upon a corrugated hurricane shutter panel incorporating keepers between respective end braces and the shutter panel.
Figure 7:
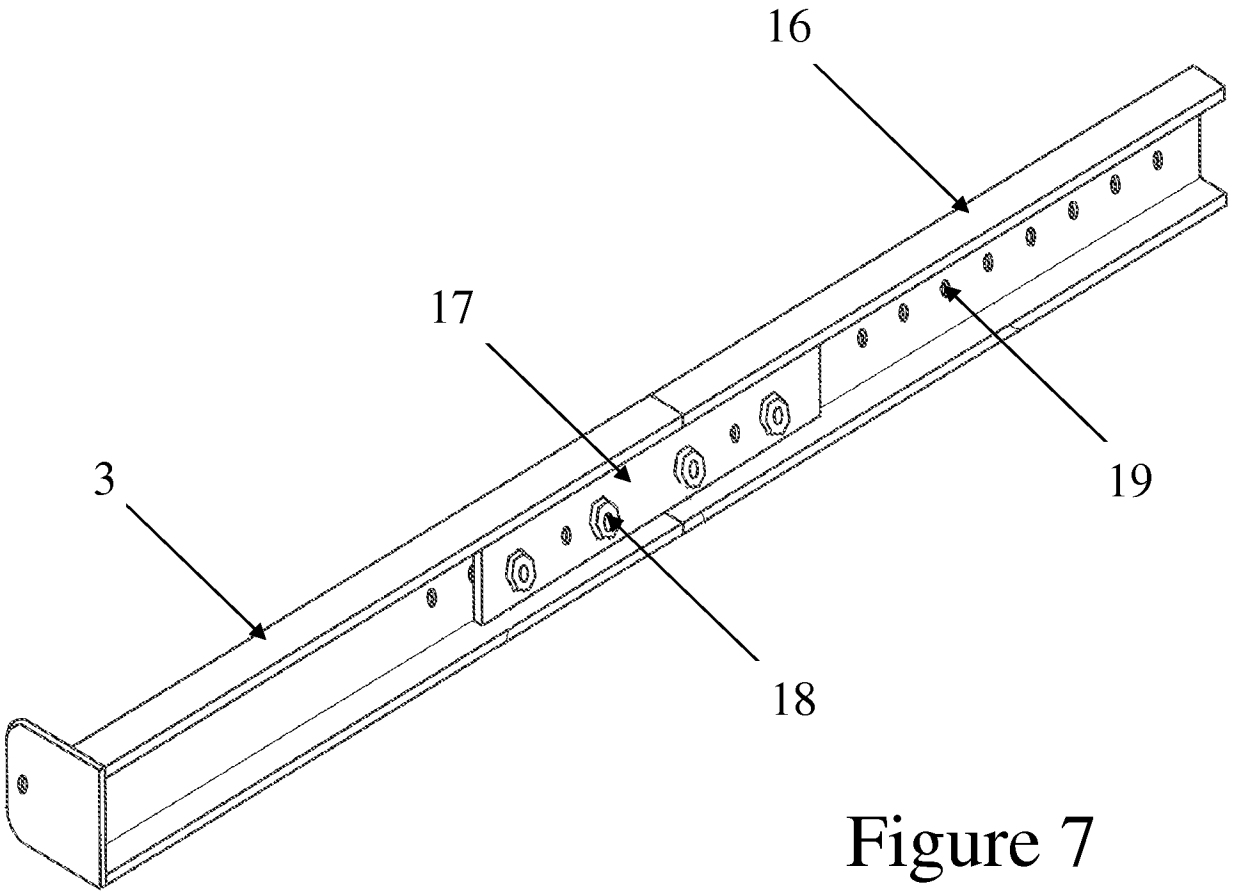
FIG. 7 is a perspective view of an alternate embodiment of the locking bar incorporating an extension bar, an extension brace, holes, and nuts and bolts holding the pieces together.

As per FIG. 1, the universal locking device (10) for hurricane shutters is illustrated and comprises two end brackets (1) that are adapted to be securely attach to an exterior wall of a building structure (31)on respective opposite adjacent sides of an opening, usually a window or door frame; at least one V-bracket (2) adapted to snugly fit within and be securely attached to respective corrugations of a corrugated panel of a hurricane shutter panel (20); and an elongated locking bar (3) adapted to pass through openings within each component used, and having a distal end and an opposite tong end, wherein said distal end has a stop portion (12) thereon, and said tong end having a plurality of holes (8) along an elongated length thereof and adapted to facilitate the use of a padlock (9) within a chosen hole depending on the width of the shutter panel used, such that said locking bar cannot be removed from said openings of said components and thereby prevents the removal of said locking device from said shutter panel and said shutter panel (20) from said building structure (31).

One embodiment of said universal locking device includes the use of a center panel locking brace (6) that fixedly attaches to a center portion of said shutter panel, said center panel locking brace having an opening therein for said locking bar to also pass therethrough, to thereby more securely hold said shutter panel to said locking bar (3).

Another embodiment of said universal locking device includes the use of a center panel lock member (4) in combination with a center brace member (5) that are both independently adapted to be fixedly attached to a center portion of said shutter panel, both said center panel lock member (4) and said center brace member (5) have an opening therein for said locking bar to also pass therethrough, to thereby more securely hold said shutter panel to said locking bar (3).

An alternate embodiment of the universal locking device incorporates keeper members (14) attached between respective end braces and the shutter panel. The use of keeper members (14) increases the strength of the connection between the locking device and the shutter panel.

An alternate embodiment of the locking bar (3) incorporates the use of an extension bar (16), an extension brace (17), holes (19), and nuts and bolts (18) holding the pieces together. The use of extension bar and extension brace allows the locking device to fit shutter panels of larger dimensions.

As to the method of use, said two end brackets are securely attached to opposite adjacent sides of a chosen opening of said building structure (31) using mechanical fasteners,(15). Then, at least one V-bracket is respectively securely attached within respectively chosen corrugations of said shutter panel using mechanical fasteners. The locking bar may be deployed at this point through the respective openings and until the stop portion hits the respective end bracket and said tong portion extends through and past the second end bracket, such that said padlock can be inserted through a chosen hole therein, thereby securing and locking said shutter panel to said building structure (31).

Within said one embodiment of said universal locking device, the method would further include securely attaching said center panel locking brace (6) to a center portion of said shutter panel, and wherein said locking bar also extends through said opening therein, to thereby more securely hold said shutter panel to said locking bar.

Within said another embodiment of said universal locking device, the method would further include securely attaching said center panel lock member (4) and said center brace member (5) to a center portion of said shutter panel, and wherein said locking bar also extends through said openings therein, to thereby more securely hold said shutter panel to said locking bar.

Within said alternate embodiment of the universal locking device incorporating keeper members (14) attached between respective end braces and the shutter panel, the user attaches the keeper members (14) to the end brackets (1), then the shutter panel to the keeper members before attaching the V-brackets and the center panel locking brace or center brace and center panel lock, to thereby increases the strength of the connection between the locking device and the shutter panel.

Within said alternate embodiment of the locking bar (3) incorporating the use of an extension bar (16), an extension brace (17), holes (19), and nuts and bolts (18) holding the pieces together, once the user determines that the width of a shutter panel is larger than the length of the locking bar, they can choose to extend the length of the locking bar by incorporating the extension bar and extension brace, to thereby extend the length of the locking device to fit shutter panels of larger dimensions.

Approximate dimensions for said end brackets can be 8 to 12 inches long, 2 to 4 inches wide, with a 1 to 2 inch wide and 6 to 8 inch long horizontal slot, with a ⅛ to 3/16 inch thickness, with a 3 to 4 inch 90 degree angle at one end with a perpendicular 2 to 3 inch long by ⅛ to 3/16 width slot therein.

Approximate dimensions for the V-brackets can be 2 to 4 inches wide, 4 to 6 inches long, ⅛ to 3/16 inch thickness, with a 2 to 4 inch wide square center base being ⅛ to 3/16 thick, with two opposite 30 to 40 degree angled sides, 2 to 4 inches wide, 3 to 4 inches long, ⅛ to 3/16 thick, and with 2 to 3 inch long by ⅛ to 3/16 inch perpendicular slots at both ends.

Approximate dimensions of the locking bar can be between 1 to 2 inches wide, 4 to 8 feet long ⅛, 3/16 inches thick, and with a 1 to 2 inch long by 1 to 2 inch wide 90 degree angel forming said stop portion at said distal end.

The universal storm panel locking device may be made of high-strength plastic or of any other sufficiently rigid and strong material such as metal, aluminum and the like. Further, the various components of the universal storm panel locking device can be made of different materials.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A universal locking device for hurricane shutters comprising two end brackets adapted to be attached to an exterior wall of a building structure on opposite sides of an opening therein, each said end bracket having an opening therethrough; at least one V-shaped bracket adapted to fit within and attach to a corrugation of a corrugated hurricane shutter panel, each said at least one V-shaped bracket having openings extending through two angled portions of said at least one V-shaped bracket; and an elongated locking bar adapted to pass through said openings of said two end brackets and said openings of said at least one V-shaped bracket, and having a distal end and an opposite tong end, wherein said distal end having a stop portion thereon, and said tong end having at least one hole; and a padlock adapted to be placed through said at least one hole of said tong end, such that said locking bar cannot be removed from said openings, and thereby prevents removal of said locking device from said shutter panel and said shutter panel from said building structure.

2. The universal locking device of claim 1, further comprising a center panel locking brace adapted to be fixedly attached to a center portion of said shutter panel, said center panel locking brace having an opening therethrough for receiving said locking bar, and adapted to hold said shutter panel to said locking bar.

3. The universal locking device of claim 2, wherein said end brackets are adapted to be connected to said exterior wall of said building structure via mechanical fasteners; and wherein said at least one V-shaped bracket and said center panel locking brace are adapted to be connected to said shutter panel via mechanical fasteners.

4. The universal locking device of claim 1, further comprising a center panel lock member, and a center brace member; said center panel lock member and said center brace member are adapted to function in combination with one another and adapted to be attached to a center portion of said shutter panel; and wherein each of said center panel lock member and said center brace member has an opening therein for receiving said locking bar for holding said shutter panel to said locking bar.

5. The universal locking device of claim 1, wherein said at least one V-shaped bracket comprises two said V-shaped brackets each adapted to fit within and attach to a respective corrugation of said corrugated hurricane shutter panel.

6. The universal locking device of claim 1, wherein each of said end brackets is L-shaped to provide a flat surface adapted to be placed flush against a flat surface of said building structure on a respective one of the opposite sides of the opening therein, and wherein said opening of each said L-shaped bracket extends perpendicularly to said flat surface of said L-shaped bracket.

7. The universal locking device of claim 1, wherein each said at least one V-shaped bracket includes a flat center portion with said two angled portions extending outwardly from opposite sides of said flat center portion at equal angles thereto.

8. The universal locking device of claim 1, further comprising keeper members attached to said two end brackets and adapted to be attached to said shutter panel.

9. The universal locking device of claim 1, further comprising an extension bar, an extension brace, and a plurality of nuts and bolts; and wherein said locking bar, said extension bar, and said extension brace respectively include a plurality of corresponding holes along the lengths thereof, such that an effective length of said locking bar can be extended when said extension bar and said extension brace are connected to said locking bar via said nuts and bolts.

10. The universal locking device of claim 1, wherein said end brackets, said at least one V-shaped bracket, and said locking bar are formed from a material selected from the group consisting of steel, aluminum, plastic, and polycarbonate plastics.

11. A hurricane shutter assembly, said assembly comprising an upper track member adapted to be secured to a building structure adjacent an upper edge of an opening in the building structure; at least one corrugated hurricane shutter panel removably attached to said upper track member and adapted to cover said building structure opening and overlap side edges of said opening; and a universal locking device comprising two end brackets adapted to be attached to said building structure adjacent the side edges of said opening, each said end bracket having an opening therethrough; at least one V-shaped bracket adapted to fit within and attach to respective corrugation of said corrugated hurricane shutter panel, each said at least one V-shaped bracket having openings extending through two angled portions of said at least one V-shaped bracket; and an elongated locking bar adapted to pass through said openings of said two end brackets and said openings of said at least one V-shaped bracket, and having a distal end and an opposite tong end, wherein said distal end having a stop portion thereon, and said tong end having at least one hole; and a padlock adapted to be placed through said at least one hole of said tong end, such that said locking bar cannot be removed from said openings, and thereby prevents removal of said locking device from said shutter panel and said shutter panel from said building structure.

12. The shutter assembly of claim 11, further comprising a center panel locking brace configured to be fixedly attached to a center portion of said hurricane shutter panel, said center panel locking brace having an opening therethrough for receiving said locking bar, and adapted to hold said hurricane shutter panel to said locking bar.

13. The shutter assembly of claim 12, wherein said end brackets are adapted to be connected to said building structure via mechanical fasteners; and wherein said at least one V-shaped bracket and said center panel locking brace are configured to be connected to said hurricane shutter panel via mechanical fasteners.

14. The shutter assembly device of claim 11, further comprising a center panel lock member, and a center brace member; said center panel lock member and said center brace member are adapted to function in combination with one another and configured to be attached to a center portion of said hurricane shutter panel; and wherein each of said center panel lock member and said center brace member has an opening therein for receiving said locking bar for holding said hurricane shutter panel to said locking bar.

15. The shutter assembly of claim 11, wherein said at least one V-shaped bracket comprises two said V-shaped brackets each adapted to fit within and attach to a respective corrugation of said corrugated hurricane shutter panel.

16. The shutter assembly of claim 11, wherein each of said end brackets is L-shaped to provide a flat surface adapted to be placed flush against a flat surface of said building structure adjacent the side edges of the opening therein, and wherein said opening of each said L-shaped bracket is extends perpendicularly to said flat surface of said L-shaped bracket.

17. The shutter assembly of claim 11, wherein each said at least one V-shaped bracket includes a flat center portion with said two angled portions extending outwardly from opposite sides of said flat center portion at equal angles thereto.

18. The shutter assembly of claim 11, further comprising keeper members attached to said two end brackets and adapted to be attached to said shutter panel.

19. The shutter assembly of claim 11, further comprising an extension bar, an extension brace, and a plurality of nuts and bolts; and wherein said locking bar, said extension bar, and said extension brace respectively include a plurality of corresponding holes along the lengths thereof, such that an effective length of said locking bar can be extended when said extension bar and said extension brace are connected to said locking bar via said nuts and bolts.

20. The shutter assembly of claim 11, wherein said end brackets, said at least one V-shaped bracket, and said locking bar are formed from a material selected from the group consisting of steel, aluminum, plastic, and polycarbonate plastics.

* * * * *